US007182642B2

(12) United States Patent
Ngo et al.

(10) Patent No.: US 7,182,642 B2
(45) Date of Patent: Feb. 27, 2007

(54) POWER CONTACT HAVING CURRENT FLOW GUIDING FEATURE AND ELECTRICAL CONNECTOR CONTAINING SAME

(75) Inventors: Hung Viet Ngo, Harrisburg, PA (US); Wilfred J. Swain, Mechanicsburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/919,632

(22) Filed: Aug. 16, 2004

(65) Prior Publication Data

US 2006/0035521 A1 Feb. 16, 2006

(51) Int. Cl.
*H01R 13/648* (2006.01)

(52) U.S. Cl. ..... 439/608

(58) Field of Classification Search ..... 439/608, 439/701, 79, 485, 607–610, 95, 941
See application file for complete search history.

(56) References Cited

U.S. PATENT DOCUMENTS

| | | | | |
|---|---|---|---|---|
| 5,052,953 | A | 10/1991 | Weber | 439/857 |
| 5,066,236 | A * | 11/1991 | Broeksteeg | 439/79 |
| 6,146,202 | A | 11/2000 | Ramey et al. | 439/608 |
| 6,293,827 | B1 * | 9/2001 | Stokoe | 439/608 |
| 6,379,188 | B1 * | 4/2002 | Cohen et al. | 439/608 |
| 6,386,924 | B2 | 5/2002 | Long | 439/701 |
| 6,669,514 | B2 | 12/2003 | Wiebking et al. | 439/701 |
| 6,705,902 | B1 * | 3/2004 | Yi et al. | 439/678 |
| 6,776,649 | B2 | 8/2004 | Pape et al. | 439/485 |
| 6,811,440 | B1 | 11/2004 | Rothermel et al. | 439/608 |
| 2001/0003685 | A1 | 6/2001 | Aritani | 439/485 |
| 2002/0106930 | A1 | 8/2002 | Pape et al. | 439/485 |
| 2003/0219999 | A1 | 11/2003 | Minich et al. | 439/79 |

* cited by examiner

*Primary Examiner*—J. F. Duverne
(74) *Attorney, Agent, or Firm*—Woodcock Washburn LLP

(57) ABSTRACT

An electrical contact for transmitting power to a printed circuit structure. The power contact comprises a main section that includes a first edge and an opposing second edge, and is made from electrically conductive material. A current-receiving interface is disposed between the main section first and second edges. And a plurality of terminals extend from the main section along the second edge. A void of electrically conductive material is formed in the main section for guiding current flow from the current-receiving interface to the terminals.

22 Claims, 8 Drawing Sheets

POWER CONTACT HAVING CURRENT FLOW GUIDING FEATURE AND ELECTRICAL CONNECTOR CONTAINING SAME

FIELD OF THE INVENTION

The present invention is directed to electrical contacts and connectors used to transmit power to printed circuit structures.

BACKGROUND OF THE INVENTION

A typical power contact employed in a ninety-degree plug connector, for example, includes a main body section having one or more beams extending from a front portion for engaging a mating contact, and multiple terminals or pins extending from a bottom portion for electrically connecting the contact to a printed circuit structure. Current will generally follow a path of least resistance from the contact beam(s) to the terminals and then into the printed circuit structure, which can result in a non-uniform distribution of current across the multiple terminals. For example, the terminals closest to the beam(s) may receive higher amps than the terminals farthest from the beam. There will be more heat produced around the terminals receiving the higher amps, which can create physical and/or electrical disadvantages. Furthermore, the terminals receiving relatively lower amps may be incapable of transmitting a sufficient level of amps, particularly where individual terminals are dedicated to transmitting power to individual layers of a layered circuit structure. Accordingly, there is a need for a power contact design that, during use, has an improved current distribution across its plurality of terminals.

SUMMARY OF THE INVENTION

The present invention is directed to electrical power contacts. In accordance with one preferred contact embodiment of the present invention, there has now been provided a power contact comprising a main section that includes a first edge and an opposing second edge, and is made from electrically conductive material. A current-receiving interface is substantially disposed between the main section first and second edges. And a plurality of terminals extend from the main section along the second edge. A void of electrically conductive material is formed in the main section for guiding current flow from the current-receiving interface to the terminals.

In accordance with another preferred contact embodiment of the present invention, there has now been provided a power contact comprising a main section that includes a current-receiving interface and is made from electrically conductive material. A plurality of terminals extend from the main section for engaging a printed circuit structure. The main section includes a slot that extends from a position proximate the current-receiving interface to a position that is between the terminal that is closest to the current-receiving interface and the terminal that is farthest from the current-receiving interface.

A third preferred contact embodiment is provided, comprising a main section that includes a void of electrically conductive material and a current-receiving interface. A plurality of terminals extend from the main section for engaging a printed circuit structure. Current flowing through each of the terminals deviates from a uniform current flow across the set of terminals by a percent difference that is less than about 59%.

In accordance with yet another contact embodiment, there has now been provided a power contact comprising a plate-like body member that includes an upper front region and a lower front region. The plate-like body member is made from electrically conductive material. A cantilevered beam extends from each of the upper and lower front regions. And there is a gap of electrically conductive material in the plate-like body member between the two front regions.

In accordance with another contact embodiment, there has now been provided a power contact comprising a main section that includes interspersed regions of electrically-conductive material and non-conductive material. A plurality of terminals extend from the main section for engaging a printed circuit structure.

The present invention is also directed to electrical power connectors. The connectors are suitable for connecting a daughter printed circuit structure to a back panel or mother printed circuit structure. The connectors can also be used to connect a daughter circuit structure to any suitable type of electrical component. Preferred electrical connectors comprise an insulative housing containing one or more of the above power contact embodiments.

These and various other features of novelty, and their respective advantages, are pointed out with particularity in the claims annexed hereto and forming a part hereof. However, for a better understanding of aspects of the invention, reference should be made to the drawings which form a further part hereof, and to the accompanying descriptive matter, in which there are illustrative embodiments.

DETAILED DESCRIPTION OF ILLUSTRATIVE EMBODIMENTS

Figure 1:
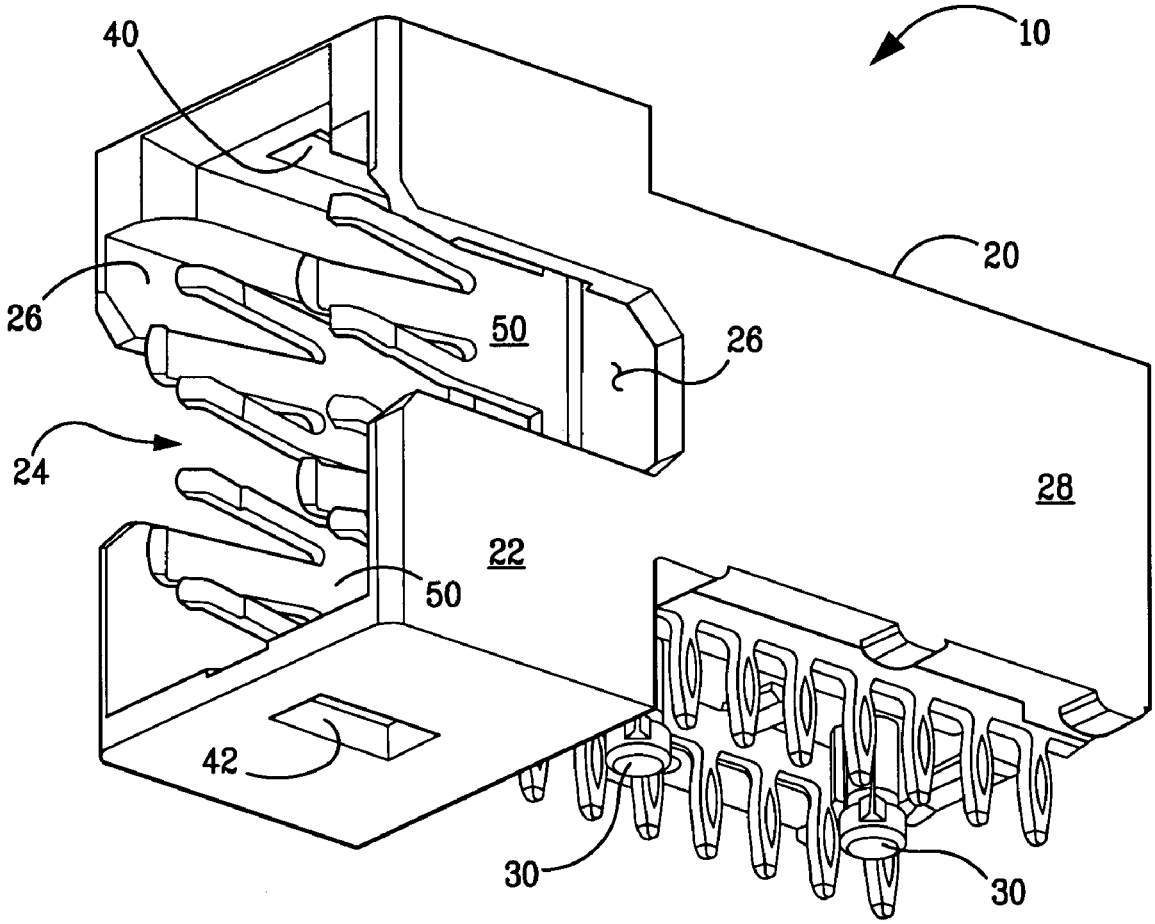
FIG. 1 is a front perspective view of an electrical connector embodiment according to the present invention.
Figure 2:
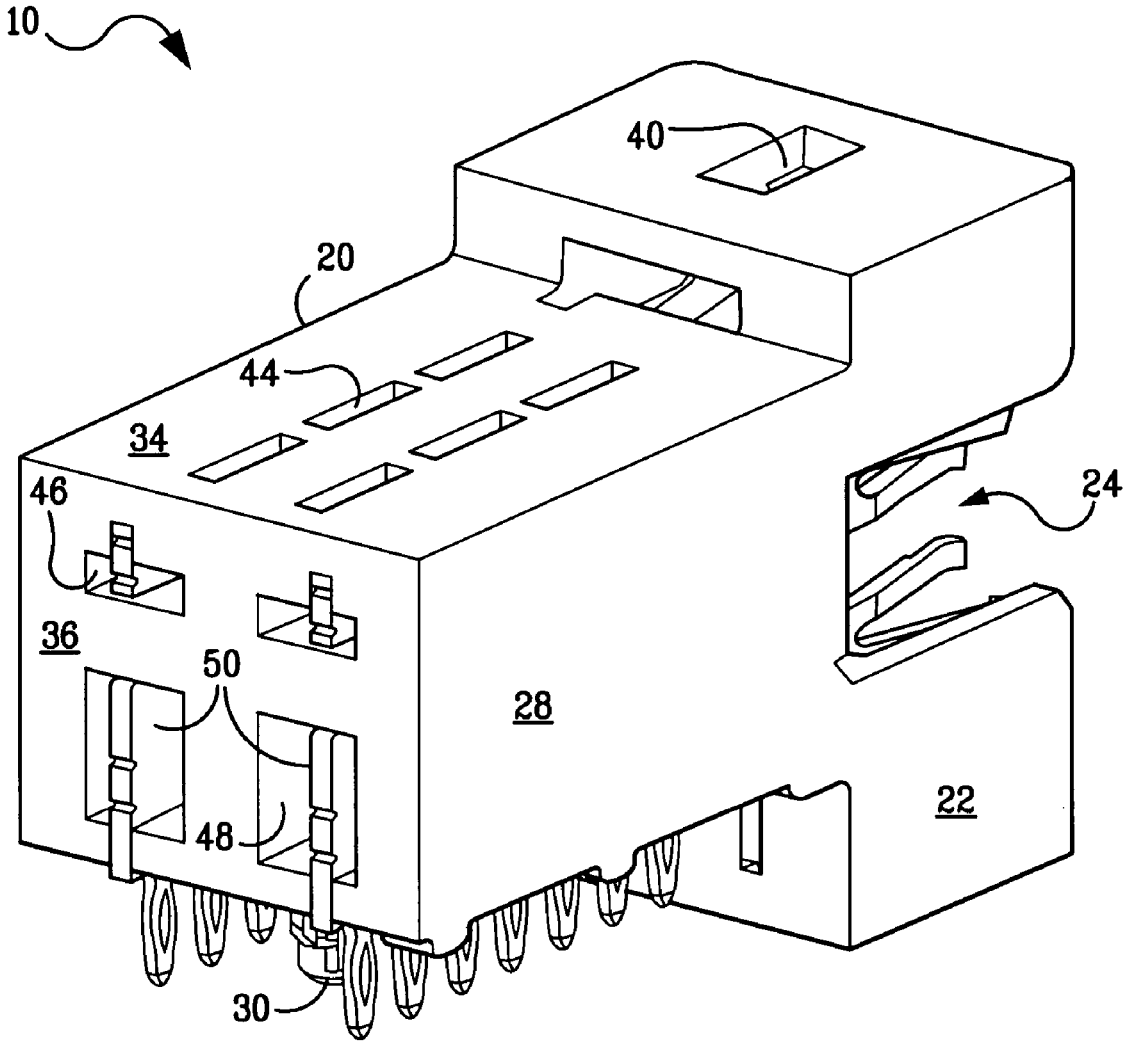
FIG. 2 is a rear perspective view of the connector shown in FIG. 1.

Referring to FIGS. 1 and 2, an electrical connector 10 is shown comprising a housing 20 and two power contacts 50. The power contacts 50, in the connector embodiment shown, are identical to each other. However, in alternate embodiments, the power contacts could be different from one another. Other connector embodiments could also have more than two contacts. Housing 20 preferably comprises a molded plastic or polymer material. A housing front section 22 is shown in FIG. 1. Front section 22 includes a mating connector receiving area 24 and optional grooves 26 that facilitate proper alignment with a mating connector. A housing rear section 28 can be seen in FIGS. 1 and 2. Rear section 28 has two mounting posts 30 for mounting connector 10 to a printed circuit structure, and contact mounting areas 32.

In preferred embodiments, housing 20 employs one or more air flow passages to enhance dissipation of heat that is generated during power transmission. By way of example, front section 22 is shown with an upper aperture 40 and a lower aperture 42. Rear section 28 includes a series of apertures 44 in top wall 34, and a series of apertures 46 and 48 in back wall 36. The air flow passages may be configured to work in concert with heat dissipation features of power contacts contained in the housing. Note that alternate connector embodiments provided by the present invention employ fewer air flow passages than that shown in the figures.

Figure 3:
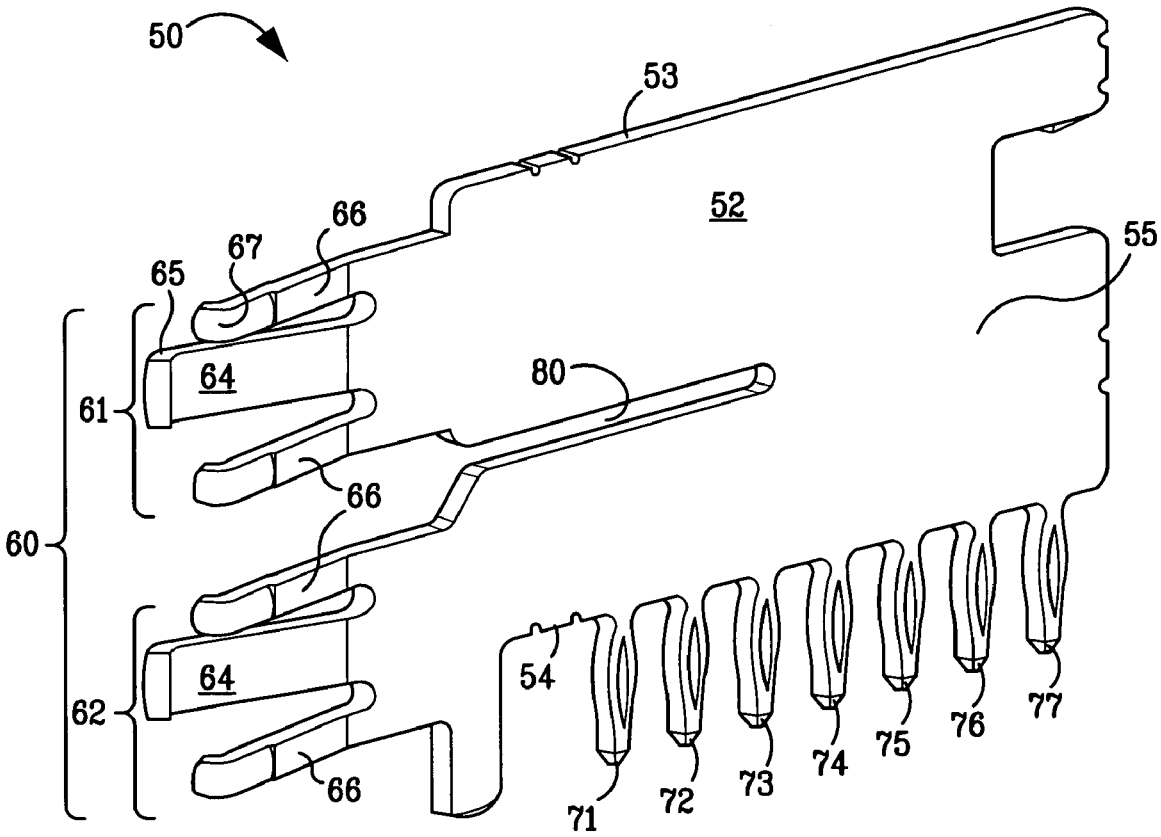
FIG. 3 is a perspective view of one preferred power contact according to the present invention.
Figure 4:
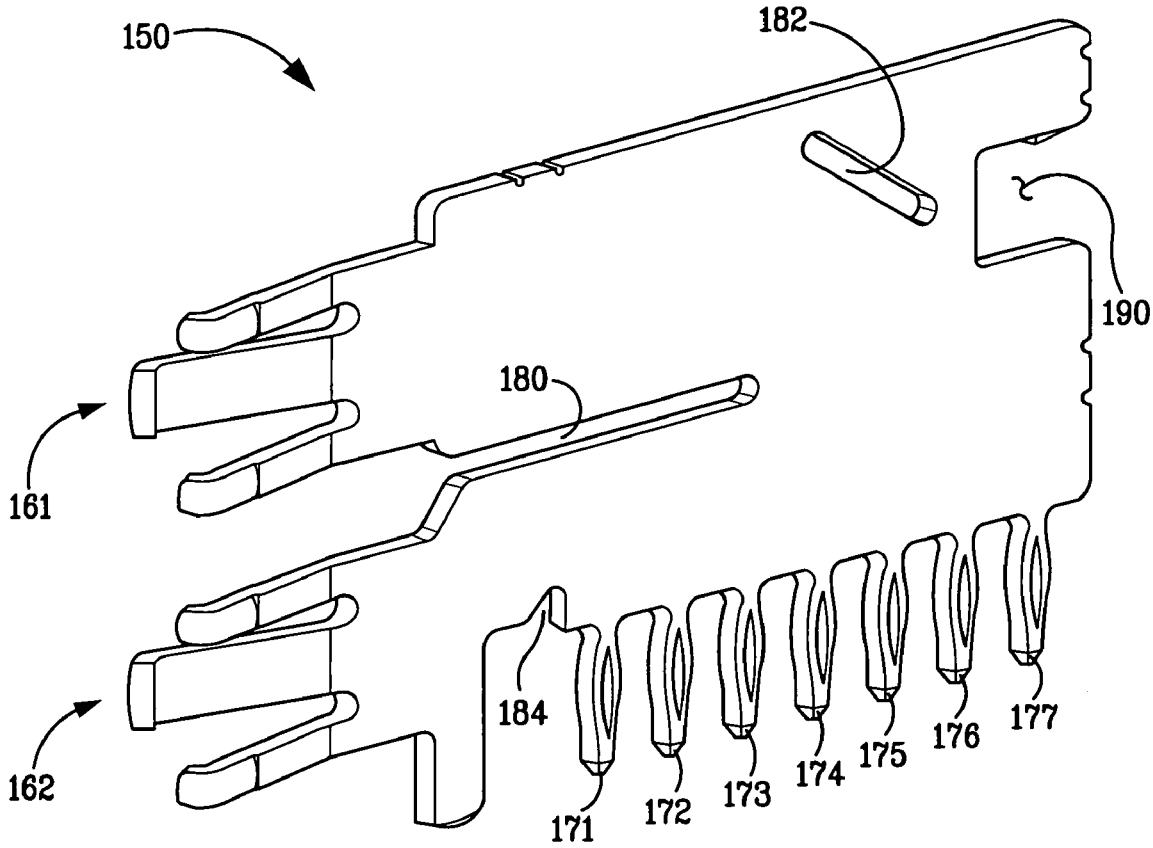
FIG. 4 is a perspective view of a second preferred power contact according to the present invention.
Figure 5:
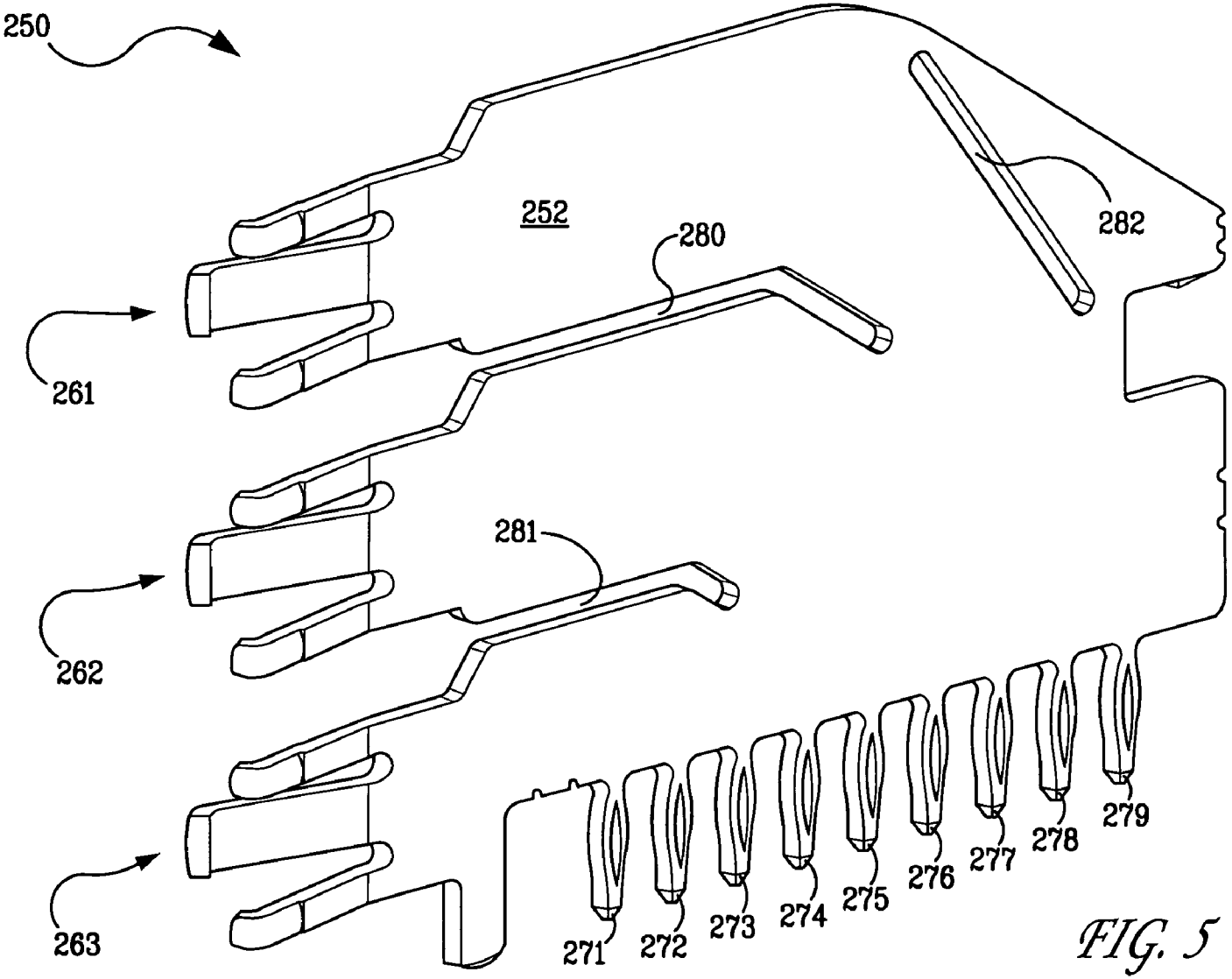
FIG. 5 is a perspective view of a third preferred power contact provided by the present invention.

Exemplary power contacts according to the present invention are shown in FIGS. 3–5. A first preferred power contact 50, shown in FIG. 3, has a main body section 52, a current-receiving interface 60 disposed between a main section top edge 53 and opposing bottom edge 54, and a plurality of terminals 71–77 extending from the main section along bottom edge 54 for transmitting power to a printed circuit structure. Main section 52 is preferably in the form of a plate-like member 55 that provides a relatively large amount of surface area which improves heat dissipation, primarily via convection. And the mass provided by the plate-like configuration allows for high power transmission without a lot of heat build-up. Plate-like member 55 is shown as a flat panel. But curved panels, and panels having both curved sections and flat sections are also contemplated by the present invention. Contacts having multiple main section panels in either a spaced apart or abutting configuration are also encompassed by the present invention.

As shown, current-receiving interface 60 includes an upper interface 61 and a lower interface 62. Each of the current-receiving interfaces 61, 62 generally comprises three forward projecting cantilevered beams; a first beam 64 and two second beams 66. The first beam 64 extends outward in a first direction, and has a contact surface 65 facing outward in the first direction. The second beams 66 are located on opposite top and bottom sides of first beam 64. Second beams 66 extend outward in a second direction, and have contact surfaces 67 facing outward in the second direction. The current-receiving interface may alternatively contain only a single cantilevered beam, or multiple beams that differ in shape and extension direction as compared to those shown and discussed above.

A mating electrical connector will employ contacts that mate with power contacts of the present invention. Current is transmitted from the mating contacts to the power contacts of the present invention, such as power contact 50, through the power contacts, and then into a printed circuit structure. Within a power contact itself, current will generally follow a path of least resistance from its current-receiving interface (e.g., cantilevered beams) to its plurality of terminals. In prior art contacts (see FIG. 6, for example), this flow pattern would tend to result in more current flowing through terminals closest to the beams and less current flowing through terminals farthest from the beams. A more uniform current flow across the multiple terminals is preferred.

The power contacts provided herein have a current flow guiding feature that promotes a more uniform current flow across the terminals. The current flow guiding feature is preferably defined by one or more voids or gaps in electrically conductive material from which the main contact section is made. By way of example, and with reference to FIG. 3, power contact 50 includes a slot 80 extending longitudinally into the main body section 52, from a position that is proximate the current-receiving interface to a position that is proximate a main section central region (that is, a location that is spaced from the periphery of the main section).

Slot 80 will guide the current flow from the current-receiving interface to the terminals. Current introduced to upper interface 61 will flow around slot 80, and then exit contact 50 primarily through terminals 74, 75, 76 and 77. And current introduced to lower interface 62 will exit contact 50 primarily through terminals 71, 72, 73 and 74. One of ordinary skill in the art would readily appreciate that the described current flow is not absolute; that is, some portion of current entering the upper and lower interfaces 61, 62 may exit power contact 50 through each of the terminals 71–77.

Other preferred power contact embodiments may include more than one void or gap in the electrically conductive material present in the contact main section. An exemplary power contact 150 is shown in FIG. 4 having three voids: a first slot 180, a second slot 182, and a notch 184. First slot 180 is similar to slot 80 in power contact 50. Second slot 182 is located in a rear contact position that is distal to the current-receiving interface. In this location, second slot 182 tends to guide current away from extreme rear portions of contact 150 that typically include contact retention features, such as, for example, notch 190, for keeping the contact properly aligned and contained within a connector housing. Notch 184 may help promote a slightly higher flow path for current introduced at lower interface 162, so that a majority of current does not simply exit power contact 150 through terminal 171, and instead, is more uniformly distributed to several terminals 171–174, for example.

Another exemplary power contact including multiple voids is shown in FIG. 5. Power contact 250 employs two longitudinally-extending slots 280 and 281, and a rear slot 282. Slots 280 and 281 are disposed in a front region of the contact main section 252 so as to create substantially distinct current flow channels corresponding to individual current-receiving interfaces 261, 262 and 263. Slots 280 and 281 are shown having angled distal portions (optional feature) that may further improve current flow uniformity across terminals 271–279.

The current flow guiding features of the present invention are preferably defined by one or more voids, gaps or notches in the contact main section. The voids can be non-filled (i.e., an air gap) or can be filled with non-conductive material, such as, for example, glass-filled thermoplastic material. Also, a power contact according to the present invention may employ a combination of filled voids and non-filled voids. With respect to the power contact embodiments shown and discussed thus far, the discontinuities do not completely separate the contact main section into multiple pieces. For example, the discontinuities included in the contacts shown in FIGS. 3–5 do not extend all the way to the bottom edge of the contacts. That is, these preferred power contacts are one-piece (unitary) designs. Further, the main contact section, the current-receiving interface, and the terminals are preferably formed from a single blank of material. The power contacts are preferably made from highly-conductive material, such as, for example, a highly conductive copper alloy material. One example of such is sold under the descriptor C18080 by Olin Corporation. Other conductive materials known in the electronics industry are also suitable. The power contacts can be made with conventional stamping and forming equipment, or other manufacturing techniques well known by persons of ordinary skill in the art of electrical connectors and contacts.

Figure 7:
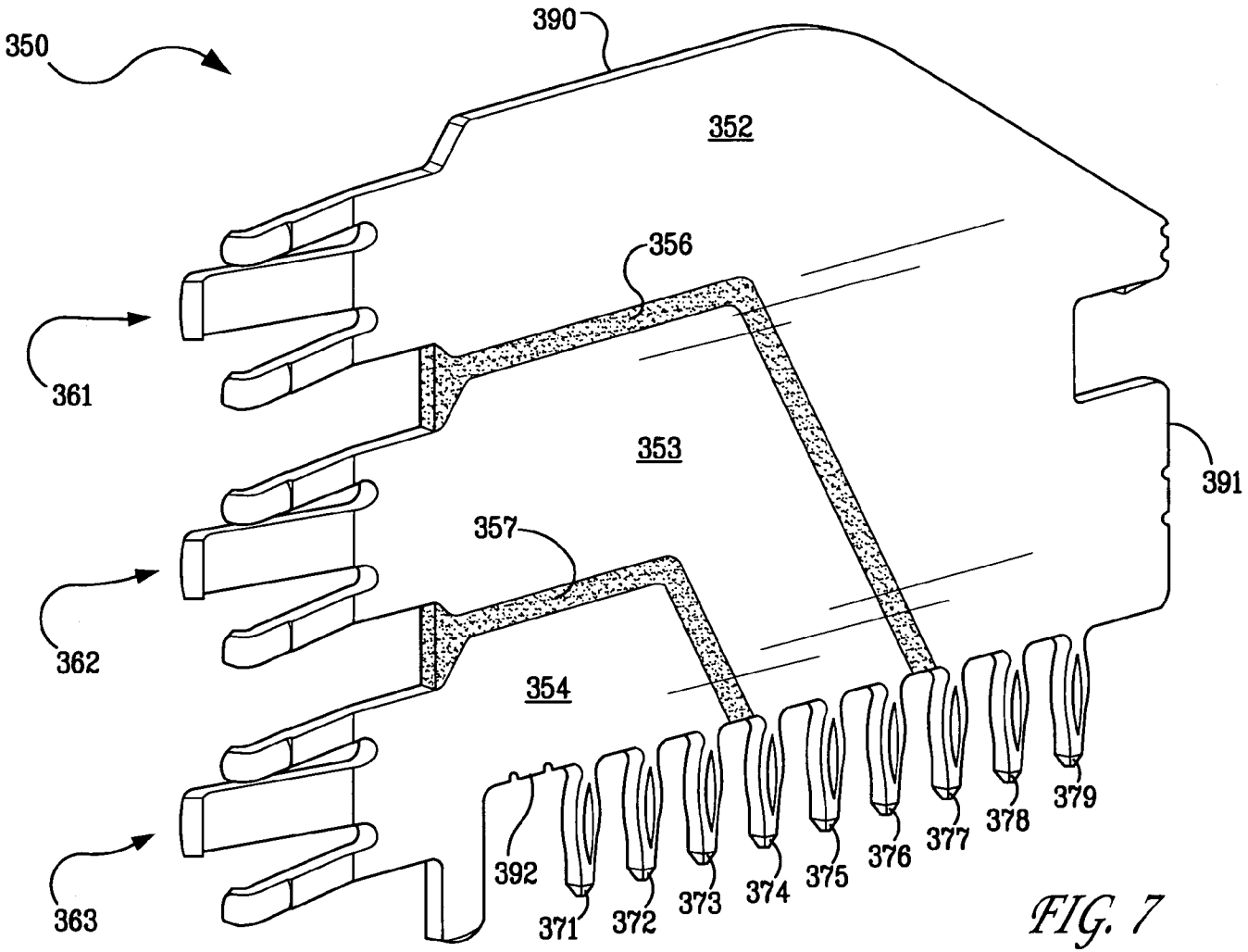
FIG. 7 is a perspective view of another preferred power contact having interspersed regions of electrically-conductive material and non-conductive material.

Referring now to FIG. 7, an alternate power contact 350 is shown having discrete current flow pathways defined by individual strips of conductive material 352–354 that are interspersed between, and preferably connected with, individual lands of non-conductive material 356–357. Exemplary conductive material includes copper alloy materials; exemplary non-conductive material includes glass-filled thermoplastics. Each of the individual strips of conductive material include an interface 360–363 (shown defined by three cantilevered beams) for receiving current, and three terminals (collectively 371–379 ) for transmitting received current to a printed circuit structure. Other current-receiving interface and terminal designs can be employed.

Figure 8:
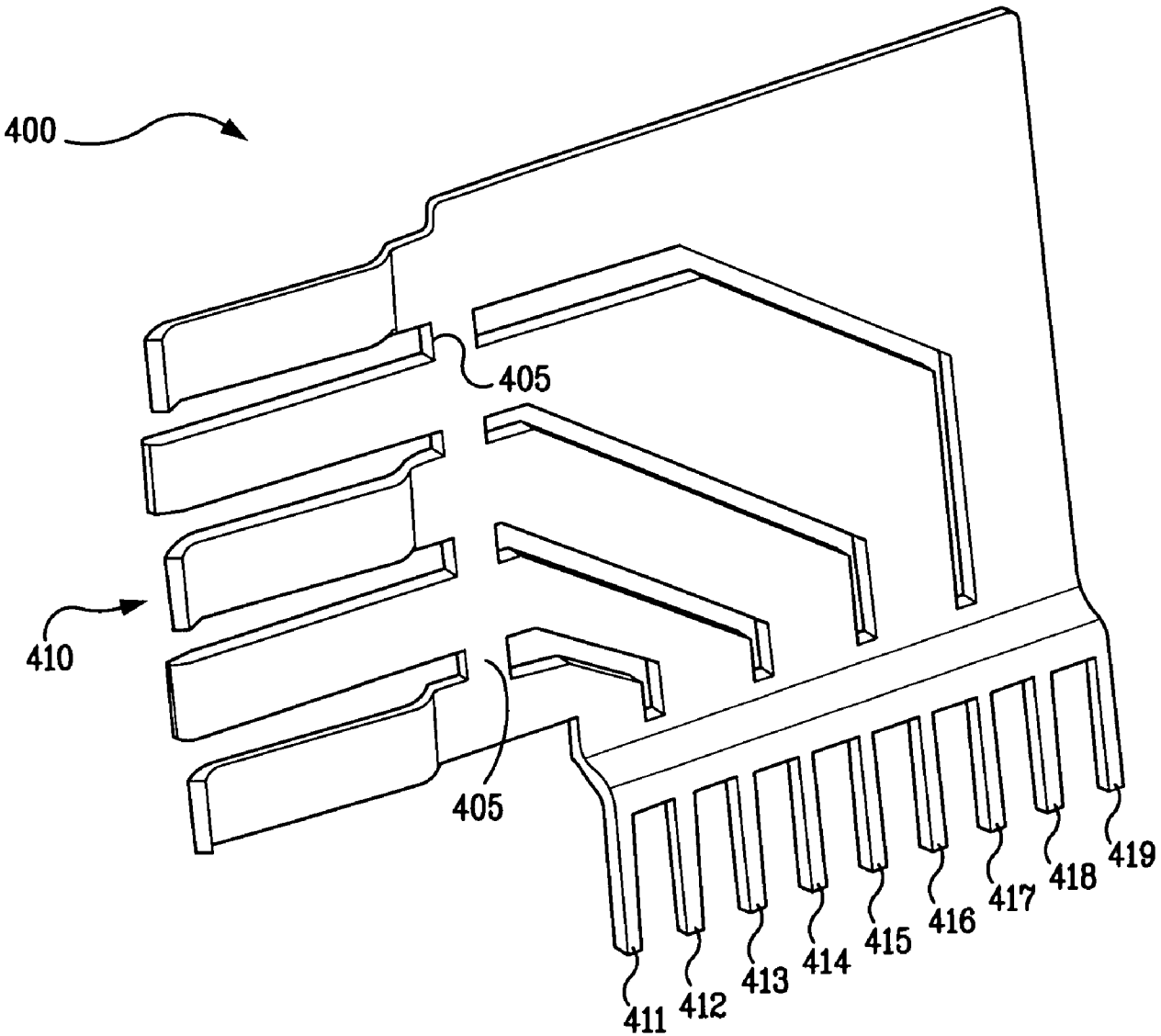
FIG. 8 is a perspective view of an exemplary power contact in accordance with the present invention.

In a preferred embodiment, and as shown in FIG. 7, at least portions of the conductive material 352–354 and the non-conductive material 356–357 lie substantially in the same plane. The individual strips of conductive material may have some connectivity to each other in the absence of interspersed non-conductive material (see, e.g., FIG. 8 wherein another exemplary contact 400 includes connectivity proximate the current-receiving interface 410, in the form of vertical cross-bars 405, and connectivity proximate the terminals 411–419). And the individual lands of non-conductive material may optionally be connected to one another. The relative dimension and geometry of each of the strips of conductive material and lands of non-conductive material can vary to that shown. Although not depicted, additional non-conductive material can be disposed around one or more power contact edges 390, 391 and 392.

EXAMPLE

Figure 6:
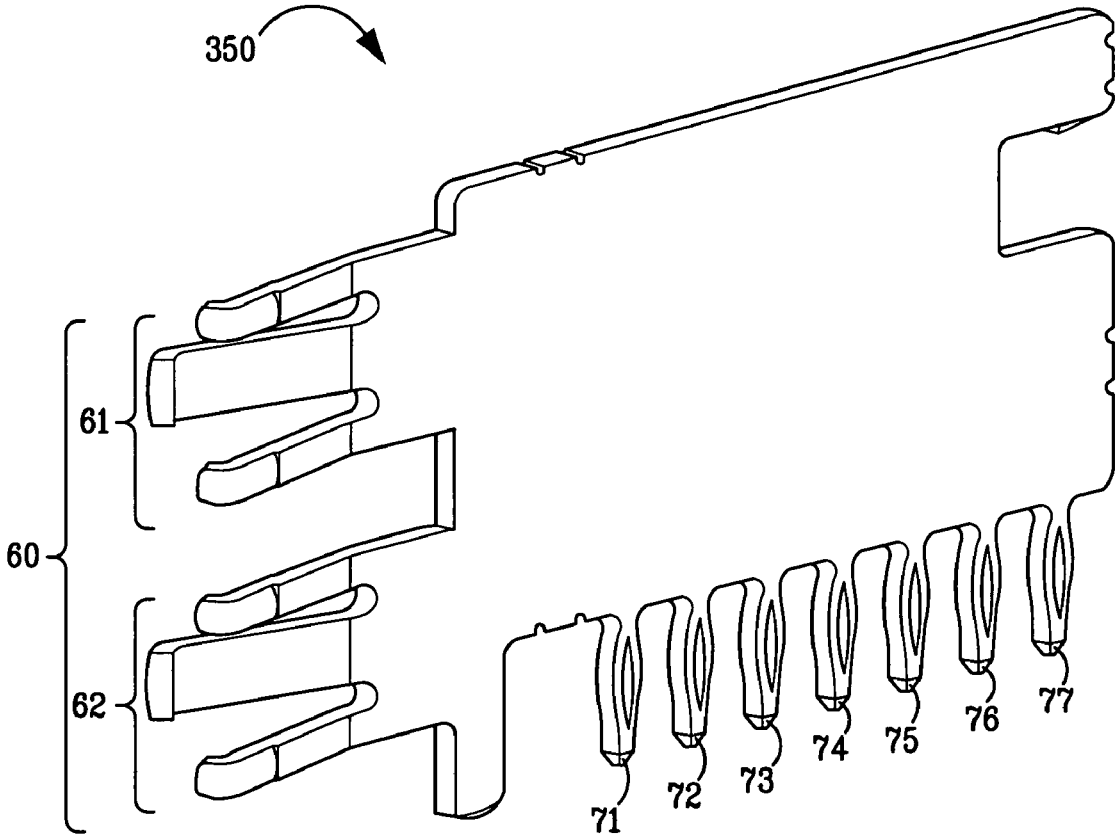
FIG. 6 is a perspective view of a prior art power contact.

A finite element analysis was conducted between two power contact designs: a first contact 350, shown in FIG. 6, having no current-flow guiding features; and a second contact 150, shown in FIG. 4, having a current-flow guiding feature defined by three voids: a first slot 180, a second slot 182, and a notch 184. The two contact designs have an identical current-receiving interface configuration and the same number of terminals (note that these features are labeled with the same reference characters). When running the analysis, the four small cantilevered beams saw 10 amps each, while the two large cantilevered beams saw 20 amps each. The predicted current exiting each of the terminals is included in Table 1 below, wherein the terminal position numbers 1–7 run from closest to the current-receiving interface to farthest from the interface.

TABLE 1

| | Current flow distribution | | | | | | |
|---|---|---|---|---|---|---|---|
| Contact | 1 | 2 | 3 | 4 | 5 | 6 | 7 |
| 350 | 23.5 A | 15.7 A | 11.7 A | 9.2 A | 7.5 A | 6.4 A | 6 A |
| 150 | 18.1 A | 13.5 A | 10.6 A | 10.0 A | 9.73 A | 9.1 A | 8.9 A |

A completely uniform current distribution across the seven terminals would be 11.42 A. Table 2 below shows the percent difference from this value for each of the two contact designs.

TABLE 2

| | Percent difference from 11.42 A | | | | | | |
|---|---|---|---|---|---|---|---|
| Contact | 1 | 2 | 3 | 4 | 5 | 6 | 7 |
| 350 | 105.8 | 37.5 | 2.5 | 19.4 | 34.3 | 44 | 47.5 |
| 150 | 58.5 | 18 | 7.2 | 12.4 | 14.8 | 20.3 | 22.1 |

As can be seen in Table 2 above, one preferred power contact according to the present invention (power contact 150 shown in FIG. 4) exhibits a maximum current flow percent difference that is essentially half of that exhibited by a prior art contact design. The largest percent difference of one of its terminals is less than about 59%, and the second largest percent difference among the remaining terminals is less than about 23%. While a finite element analysis only provides a predicted value, actual values of current flowing through terminals of a power contact can be measured by techniques known in the electronics industry. For example, a DC digital volt meter can be used to measure the voltage drop and current at each of the individual terminals. Applicant intends percent difference values recited in the claims be construed broadly to include predicted values (via computer modeling) and actual values.

Although all of the connectors and power contacts shown in the figures are particularly suitable for a ninety-degree connection, other connector and contact configurations are contemplated by the present invention. It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of features within the principles of the invention to the full extent indicated by the broad general meaning of the terms in which the appended claims are expressed.

What is claimed:

1. A power contact, comprising:

a main section including a first edge and an opposing second edge, and being made from electrically conductive material;

a current-receiving interface disposed between the first edge and the second edge;

a plurality of terminals extending from the main section and along the second edge; and at least one void of electrically non-conductive material formed in the main section for guiding current flow from the current-receiving interface to the plurality of terminals such that current is distributed among individual terminals of the plurality of terminals, wherein the at least one void does not separate the main section into multiple pieces.

2. The power contact of claim 1, wherein the at least one void includes a longitudinally-extending slot extending from the current-receiving interface to a position proximate a central region of the main section.

3. The power contact of claim 1, wherein the at least one void includes two slots.

4. The power contact of claim 1, wherein the at least one void includes a first slot extending into the main section from the current-receiving interface and a second slot in the main section that is spaced apart from the first slot.

5. The power contact of claim 1, wherein the current-receiving interface includes at least one cantilevered beam.

6. An electrical connector, comprising:

an insulative housing; and a power contact according to claim 1 disposed in the insulative housing.

7. A power contact, comprising:

a main section including a current-receiving interface and being made from electrically conductive material;

a plurality of terminals extending from the main section for engaging a printed circuit structure, the plurality of terminals including a first terminal that is closest to the current-receiving interface and a second terminal that is farthest from the current-receiving interface; and a slot disposed in the main section extending from a position proximate the current-receiving interface to a position that is between the first terminal and the second terminal.

8. The power contact of claim 7, further comprising a second slot disposed in the main section and positioned above the second terminal.

9. The power contact of claim 7, wherein the current-receiving interface includes one or more cantilevered beams extending from the main section.

10. The power contact of claim 7, wherein the current-receiving interface includes an upper interface and a lower interface, each of the upper and lower interfaces comprising at least one cantilevered beam.

11. The power contact of claim 10, wherein the slot is disposed between the upper interface and the lower interface.

12. An electrical connector, comprising:

an insulative housing; and a power contact according to claim 7 disposed in the insulative housing.

13. The power contact of claim 7, wherein the power contact is a one-piece design.

14. A power contact, comprising:

a main section including two or more electrically interconnected, individual strips of electrically conductive material;

a current-receiving interface extending from a first edge of the main section; and a plurality of terminals extending from a second edge of the main section for engagement with a printed circuit; and individual strips of electrically non-conductive material interspersed with the individual strips of electrically conductive material.

15. The power contact of claim 14, wherein interconnectivity is proximate the current-receiving interface.

16. The power contact of claim 14, wherein interconnectivity is proximate the plurality of terminals.

17. The power contact of claim 14, wherein interconnectivity is both proximate the current-receiving interface and the plurality of terminals.

18. The power contact of claim 14, wherein the individual strips of electrically conductive material and the individual strips of electrically non-conductive material lie in the same plane such that the materials are coterminous widthwise.

19. The power contact of claim 14, wherein an air gap exists between at least some of the individual strips of conductive material.

20. A power contact, comprising a main body section, a first and a second contact beam extending from a first edge of the main body section, and a contact terminal extending from a second edge of the main body section, wherein the main body section has a void formed therein, the void extends from the first edge of the main body section, and the void defines a first discrete current flow pathway to and from the first contact beam, and a second discrete current flow pathway to and from the second contact beam.

21. The power contact of claim 20, wherein the first discrete current flow pathway extends along one side of the void, and the second discrete current flow pathway extends along another side of the void.

22. The power contact of claim 20, wherein the first discrete current flow pathway adjoins the second discrete current flow pathway proximate an end of the void.

* * * * *

UNITED STATES PATENT AND TRADEMARK OFFICE

CERTIFICATE OF CORRECTION

PATENT NO. : 7,182,642 B2
APPLICATION NO. : 10/919632
DATED : February 27, 2008
INVENTOR(S) : Hung Viet Ngo and Wilfred J. Swain It is certified that error appears in the above-identified patent and that said Letters Patent is hereby corrected as shown below:

COL. 8, line 2, after “printed circuit” insert --structure--

Signed and Sealed this

Twenty-fourth Day of June, 2008

JON W. DUDAS
*Director of the United States Patent and Trademark Office*